United States Patent [19]

Blaimschein

[11] Patent Number: 4,494,280

[45] Date of Patent: Jan. 22, 1985

[54] METHOD AND MACHINE TOOL FOR A CIRCULAR MACHINING OF ECCENTRIC SHAFT PORTIONS

[75] Inventor: Gottfried Blaimschein, Steyr, Austria

[73] Assignee: GFM Gesellschaft für Fertigungstechnik und Maschinenbau Gesellschaft m.b.H., Steyr, Austria

[21] Appl. No.: 400,110

[22] Filed: Jul. 20, 1982

[30] Foreign Application Priority Data

Aug. 18, 1981 [DE] Fed. Rep. of Germany ..... 3132560

[51] Int. Cl.[3] ..... B23C 3/06

[52] U.S. Cl. ..... 29/6; 51/90; 51/105 SP; 409/199; 409/200

[58] Field of Search ..... 409/200, 199, 213, 198, 409/190, 191; 29/6; 51/43, 73 GL, 90, 105 SP

[56] References Cited

U.S. PATENT DOCUMENTS

| | | | |
|---|---|---|---|
| 1,956,068 | 4/1934 | Herzog | 51/90 |
| 2,693,066 | 11/1954 | Berstether | 51/43 |
| 3,595,131 | 7/1971 | Rozonek et al. | 409/122 |
| 3,880,025 | 4/1975 | Kralowetz et al. | 409/200 |
| 4,257,724 | 3/1981 | Blaimschein et al. | 409/199 |
| 4,309,134 | 1/1982 | Schmid | 409/199 X |
| 4,326,323 | 4/1982 | Kralowetz et al. | 409/199 X |
| 4,346,535 | 8/1982 | Asano et al. | 51/105 SP |
| 4,388,027 | 6/1983 | Blain | 409/199 |

*Primary Examiner*—William R. Briggs
*Attorney, Agent, or Firm*—Kurt Kelman

[57] ABSTRACT

When it is desired to machine crankpins of crankshafts to a circular cross section with a surrounding cutting tool, which is rotated or oscillated, the tool is longitudinally positioned relative to the crankpin and machines the same while engaging the crankpin and a circular feed movement of the tool relative to the crankpin is effected. To permit a fast and efficient circular machining, the crankpin is held in position and the driven tool is moved during the machining along a circular path surrounding the crankpin. When the tool has been longitudinally positioned, the crankpin and the tool are transversely displaced relative to each other until the center of the circular cross section coincides with the center of the circular path of the tool.

18 Claims, 5 Drawing Figures

METHOD AND MACHINE TOOL FOR A CIRCULAR MACHINING OF ECCENTRIC SHAFT PORTIONS

BACKGROUND OF THE INVENTION (1) Field of the Invention

This invention relates to a method for a circular machining of eccentric shaft portions, particularly crankpins of crankshafts, comprising an externally cutting, rotating or oscillating tool, such as a grinding wheel, a tool of a superfinishing device, or an end mill, which tool is longitudinally positioned to engage the shaft portion and machines the same as an angular feed movement relative to the workpiece is imparted to the tool.

(2) Description of the Prior Art

To permit a higher surface finish to be obtained and smaller dimensional tolerances to be adhered to, it is often necessary to machine workpieces in a plurality of operations. In most cases the workpieces are milled or turned and then finished by grinding or superfinishing. These finishing operations are performed by externally cutting tools, which rotate or oscillate. So far, to use of such driven tools for machining eccentric shaft portions, such as the crankpins of a crankshaft, has been time-consuming and complicated and has required expensive machine tools because an angular feed movement is to be imparted to the workpiece as it is machined and for this purpose the workpiece must be rotated about the axis of the eccentric portion which is to be machined. For this purpose the workpiece must be eccentrically gripped and its gripping arrangement must be changed when a different portion is to be machined. Besides, expensive means are required for driving the workpiece and the rotation of the workpiece involves a rotary unbalance, which adversely affects the machining conditions.

SUMMARY OF THE INVENTION

It is an object of the invention to eliminate these disadvantages and to provide a method which is of the kind described first hereinbefore and which permits a circular machining of eccentric shaft portions in a relatively fast, efficient and inexpensive manner. A machine tool which is highly suitable for carrying out that process and as simple as possible is also to be provided.

This object is accomplished in accordance with the invention in that the driven tool is moved along a circular path which surrounds the workpiece as the latter is machined, the workpiece is held in position as it is machined, and when the tool has been longitudinally positioned relative to the workpiece the tool and the workpiece are transversely displaced relative to each other until the center of the desired cross-section of the shaft portion to be machined coincides with the center of the circular path of the tool, which is subsequently engaged with the workpiece. Because the workpiece is held in position as it is machined and the tool performs also the circular feed movement, optimum cutting and machining conditions can be obtained with a relatively simple structure. Besides the movement of the tool along a circular path can be effected in a simpler manner and with higher accuracy than a rotation of the workpiece with rotary unbalance. Whereas it was previously necessary to eccentrically grip the tool and to frequently change that grip, it is now sufficient to effect a transverse displacement, which can be rather easily performed within a short time. For this purpose the workpiece which is held against rotation may be displaced whereas the tool is held in position or the workpiece may be held in position and the tool may be transversely displaced. In no case is it necessary to change the grip of the workpiece or to rotate the latter as it is machined, whether a centered or eccentric shaft portion is to be machined.

A machine tool which is particularly suitable for carrying out the method according to the invention comprises two gripping heads and a tool carriage, which are mounted on a machine bed and longitudinally displaceable relative to each other. The tool carriage may consist of a compound slide or the gripping heads may be provided with chucks which are displaceable in planes that are normal to each other and to the axis of the workpiece. The tool carriage comprises a carrying ring, which is known per se and adapted to be driven, and a radially movable slide is guided in said carrying ring and carries a machining unit which comprises the tool and means for driving the tool. The rotation of such carrying ring will virtually automatically impart to the tool a movement along a circular path and the tool can easily be moved radially into engagement with the workpiece by the radially movable slide. As the latter carries the machining unit, which comprises the tool and the means for driving the tool, the tool, in spite of the provision of the special means for driving the tool, can be moved into engagement with the workpiece and fed relative to the workpiece without any restriction and the tool proper will be stably held. The carrying ring must be so large that it can surround the workpiece and can be displaced relative to the workpiece also in an axial direction. The longitudinal positioning is effected in a conventional manner and in dependence on the concept of the machine tool in that the carriage is moved or in that the two gripping heads which grip the workpiece are displaced jointly. When the tool has been positioned, the axis of the carrying ring can be quickly and easily moved to coincide with the axis of the desired cross-section of the shaft portion which is to be machined. For this purpose, a compound slide may be used to move the carrying ring in the desired direction, which is normal to the axis of the workpiece, or the gripping heads may be displaced in synchronism to move the workpiece parallel to itself in the desired direction to the extent of its eccentricity. Compound tool slides are well known and, as shown, for example, in U.S. Pat. Nos. 3,880,025 and 4,326,323, comprise horizontally and vertically movable slides. The same result can be obtained if the carrying ring is movable relative to the machine bed in a first direction that is normal to the longitudinal axis of the workpiece, and chucks in which the workpiece is gripped are movable relative to the machine bed in a second direction, which is normal to the first direction and to the longitudinal axis of the workpiece. The radially movable slide can then be moved to engage the tool with the workpiece and the carrying ring can subsequently be rotated to impart to the rotating or oscillating tool the circular feed movement required for the desired machining of the shaft portion. When the machining proper has been effected, the parts are returned to their initial positions and the machine is then ready to perform the next operation.

BRIEF DESCRIPTION OF THE DRAWING

Illustrative embodiments of the invention are shown by way of example on the drawing, in which.

DESCRIPTION OF THE PREFERRED EMBODIMENTS

Figure 1:
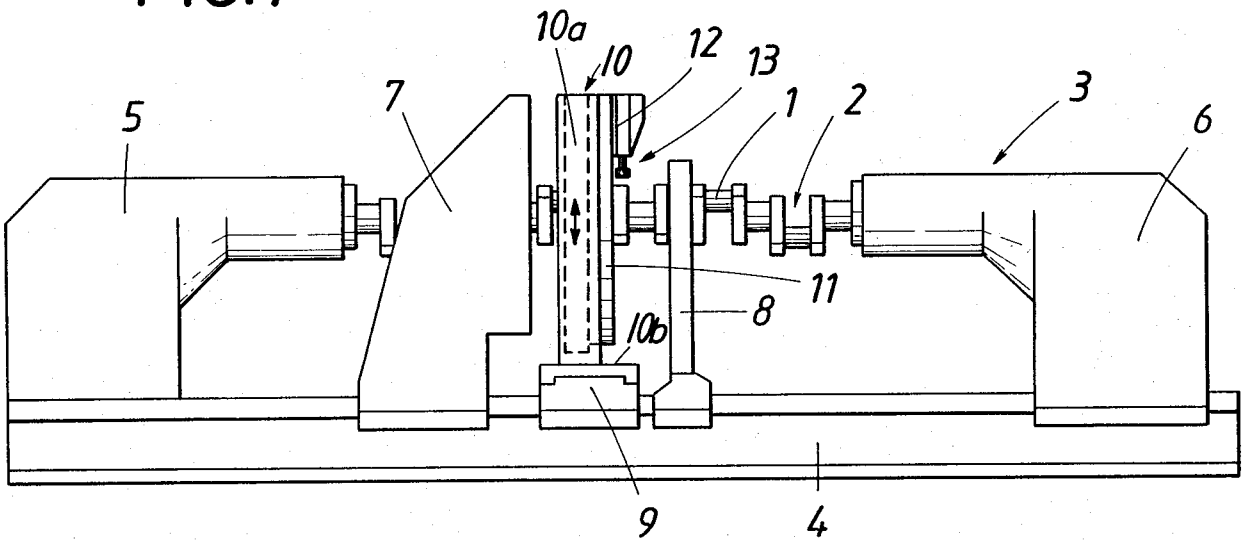
FIG. 1 is a side elevation showing a machine tool according to the invention.

A machine tool 3 for an efficient circular machining of eccentric shaft portions, such as the crankpins 1 of a crankshaft 2, comprises a machine bed 4, two gripping heads 5, 6 for holding the workpiece between them, two back rests 7, 8, which also support the workpiece, and compound tool slide 10 carried by a carriage 9, which is movable along the machine bed 4. The illustrated compound tool slide 10 comprises horizontally movable slide 10*b* mounted on carriage 9 and having two vertical guides 10*a* vertically slidably supporting vertical slide 9*a*. A carrying ring 11 is rotatably mounted in vertical slide 9*a* of the tool slide 10 and is adapted to be driven so that it rotates about its axis. A radially movable slide 12 is adjustably mounted in the carrying ring 11 and carries a machining unit 13, which consists of a tool and means for driving the tool.

Figure 3:
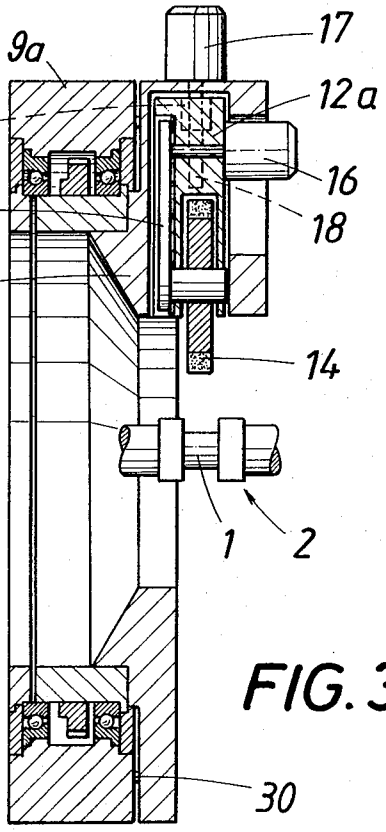
FIGS. 2 and 3 are, respectively, in an end view and axial sectional view on a larger scale a machining unit used in that machine tool
Figure 2:
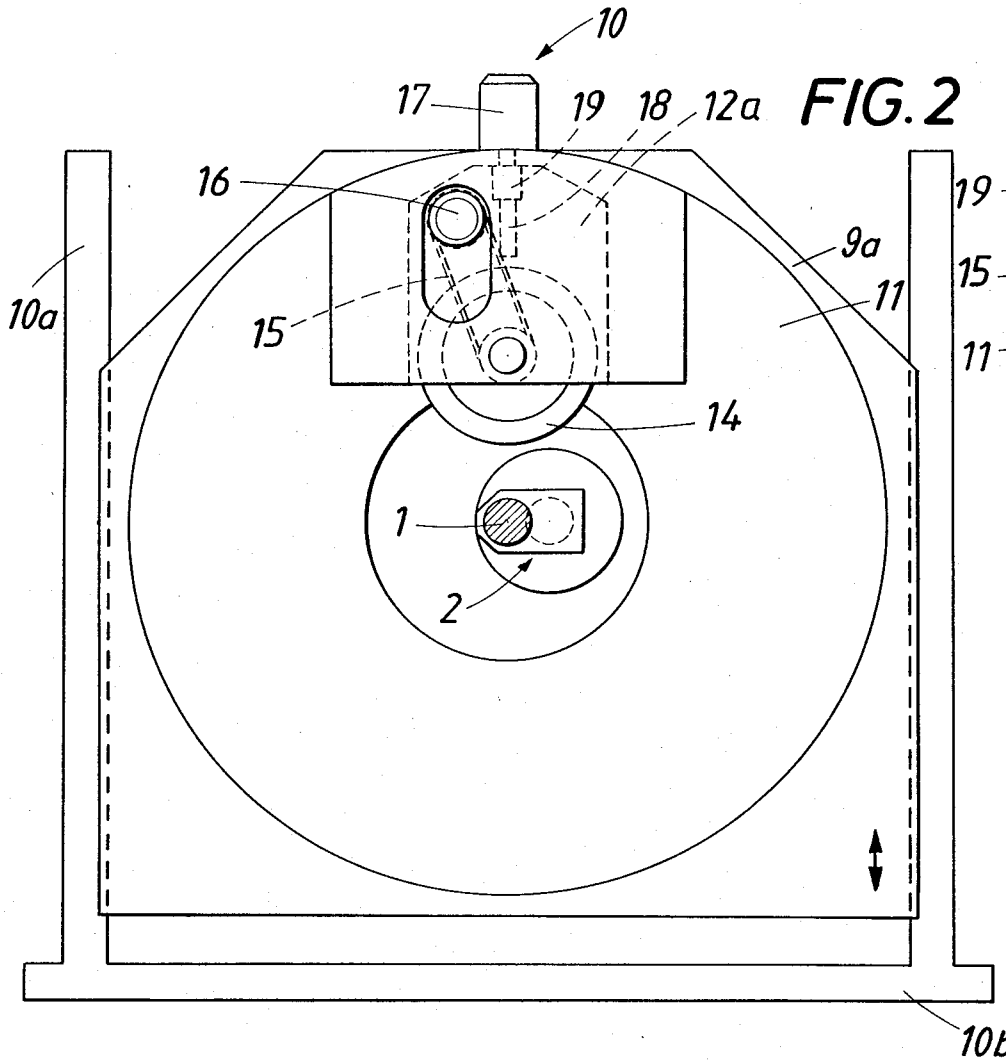

As is indicated in FIGS. 2 and 3, the machining unit 13 carried by the radially movable slide 12*a*, which is guided in the carrying ring 11, may comprise a grinding wheel 14, a belt drive 15 and a drive motor 16. An adjusting screw 18 driven by a motor 17 and in threaded engagement with an adjusting nut 19 of the radially movable slide 12*a* may be provided for adjusting the slide 12*a* so as to engage the grinding wheel 14 with the shaft portion that is to be machined.

Figure 4:
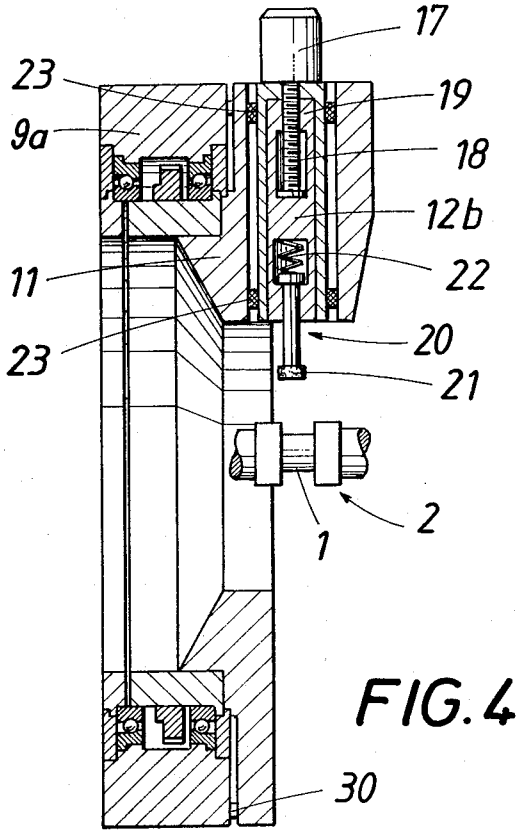

The machining unit shown in FIG. 4 consists of a superfinishing device 20, which is mounted in the radially movable slide 12*b* and includes a tool consisting of a superfinishing stone 21, which is oscillated by a diagrammatically indicated pneumatic drive 22. In this case too, the radially movable slide 12 is movable by an adjusting drive comprising a motor 17, an adjusting screw 18 and an adjusting nut 19. Vibration-damping inserts 23 are provided to prevent a transmission of vibration to the carrying ring 11.

Figure 5:
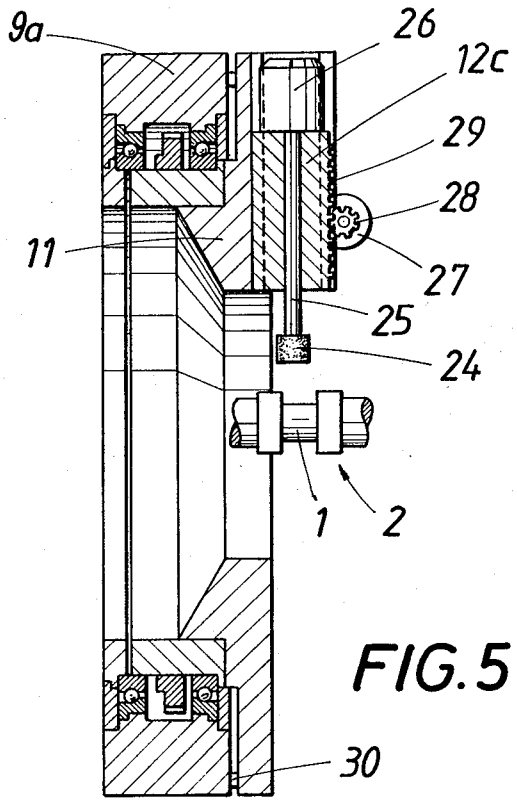
FIGS. 4 and 5 are axial sectional views which are similar to FIG. 3 and show two other illustrative embodiments of such a machining unit.

As is apparent from FIG. 5, the machining unit carried by the radially movable slide 12*c* may comprise a milling tool, such as an end mill 24, which is mounted on a driving spindle 25. The latter is rotatably mounted in the radially movable slide 12*c* and is driven by a motor 26. In this case the radially movable slide 12*c* can be adjusted by a pinion 28, which is driven by the motor 27 and in mesh with a rack 29 of the radially movable slide 12*c*.

By means of the carrying ring 11, the machining unit can be moved along a circular path around the workpiece so that eccentric shaft portions can be machined to a circular shape in a simple manner in that the carrying ring which has been longitudinally positioned is transversely displaced to a position in which it is coaxial to the desired cross-section of the eccentric shaft portion to be machined. Then the carrying ring can be used in an efficient manner to impart the circular feed movement to the tool. As the carrying ring 11 is rotated, the radially movable slide 12 guided in the carrying ring and the machining unit carried by the radially movable slide are moved around the workpiece so that the latter can be machined as desired without difficulty. The radially movable slide can be adjusted as is required for that machining. Simple ring conduits 30 are provided between the carrying ring 11 and the machine tool 10 and serve to power and control the machining unit 13 carried by the radially movable slide 12 and the drive means for adjusting the radially movable slide.

What is claimed is:

1. In a method of machining a shaft workpiece with an externally cutting tool to form said shaft workpiece with an eccentric portion having a predetermined circular cross-section, comprising the steps of moving said tool relative to said shaft workpiece in the longitudinal direction of the latter to position said tool adjacent to a predetermined portion of said shaft workpiece, moving said tool transversely to the longitudinal direction of said shaft workpiece to engage said tool with said shaft workpiece, and machining said predetermined portion of said shaft workpiece with said tool while imparting to said tool and said shaft workpiece a feed movement relative to each other whereby said tool is moved around said shaft workpiece along a predetermined circular path, the improvement residing in that after said tool has thus been positioned, said tool and said predetermined portion of said shaft workpiece are moved relative to each other in a direction which is transverse to said longitudinal direction to a position in which the center of said predetermined cross-section of said eccentric portion coincides with the center of said circular path, said tool is subsequently moved to engage said predetermined portion of said shaft workpiece, said tool which engages said predetermined portion of said shaft workpiece is driven to machine said predetermined portion of said shaft workpiece, said shaft workpiece is held in position as it is machined by said tool, and said tool is moved around said shaft workpiece along said circular path as said predetermined portion of said shaft workpiece is machined by said tool.

2. The improvement set forth in claim 1 as applied to the machining of a shaft workpiece to form the latter with a plurality of longitudinally spaced apart eccentric portions, each of which has a predetermined circular cross-section, wherein said steps of positioning said tool adjacent to a predetermined portion of said shaft workpiece of moving said tool and said predetermined portion of said shaft workpiece to a position in which the center of said predetermined cross-section of said eccentric portion coincides with the center of said circular path, and of engaging said tool with said shaft workpiece are performed before the machining of said shaft workpiece to form it with each of said eccentric portions.

3. The improvement set forth in claim 1 when applied to the machining of a crankshaft workpiece to form it with a crankpin which constitutes said eccentric shaft portion.

4. The improvement set forth in claim 1 when applied to the machining of said shaft workpiece with a tool which is rotated to machine said shaft portion.

5. The improvement set forth in claim 1 when applied to the machining of said shaft workpiece with a tool which is oscillated to machine said shaft portion.

6. The improvement set forth in claim 1 when applied to the machining of said shaft portion with a tool consisting of a grinding wheel.

7. The improvement set forth in claim 1, when applied to the machining of said shaft portion with a tool which is comprised in a superfinishing device.

8. The improvement set forth in claim 1, when applied to the machining of said shaft workpiece with said tool consisting of an end mill.

9. In a machine tool for machining a shaft workpiece to form it with an eccentric portion having a predetermined circular cross-section, comprising an externally cutting tool for machining said shaft workpiece to form it with said eccentric portion, two spaced apart gripping means defining a longitudinal axis and operable to grip said workpiece so that it extends along and is centered on said longitudinal axis, first tool-positioning means for moving said tool relative to said gripping means along said longitudinal axis to position said tool adjacent to a predetermined portion of a shaft workpiece gripped by said gripping heads, second tool-positioning means for moving said tool relative to said gripping heads transversely to said longitudinal axis to engage said tool with said predetermined portion of said shaft workpiece gripped by said gripping means, a feed drive for imparting to said tool and said gripping means a feed movement relative to each other whereby said tool is moved around said longitudinal axis along a circular path while said tool engages said predetermined portion of said shaft workpiece gripped by said gripping means, and tool-driving means for imparting to said tool a cutting movement when said tool is engaged with said predetermined portion of said shaft workpiece gripped by said gripping heads and is moved around said longitudinal axis along said circular path, the improvement residing in that said gripping heads are operable to hold said shaft workpiece in position, third tool-positioning means are provided, which are operable to move said tool and said gripping means relative to each other in a direction which is transverse to said longitudinal axis to a position in which the center of said predetermined cross-section of said eccentric portion coincides with the center of said circular path, said second tool-positioning means are connected to said tool and operable to move said tool into engagement with said predetermined portion of said workpiece when the center of said predetermined cross-section of said eccentric portion coincides with the center of said circular path, and said feed drive is connected to said tool and operable to move said tool along said circular path.

10. The improvement set forth in claim 9, wherein said tool-driving means are operable to rotate said tool about its own axis.

11. The improvement set forth in claim 9, wherein said tool-driving means are operable to oscillate said tool.

12. The improvement set forth in claim 1, wherein said third tool-positioning means are operable to move said tool and said gripping means relative to each other in two directions, which are normal to each other and to said longitudinal axis.

13. The improvement set forth in claim 12, wherein said third tool-positioning means are connected to said gripping means and operable to move said gripping means relative to said tool in two directions, which are normal to each other and to said longitudinal axis.

14. The improvement set forth in claim 13, wherein said gripping means consist of two spaced apart chucks, which are carried by respective gripping heads and movable relative to said gripping heads in two directions which are normal to each other and to said longitudinal axis.

15. The improvement set forth in claim 12, wherein said third tool-positioning means are operable to move said tool relative to said gripping means in two directions, which are normal to each other and to said longitudinal axis.

16. The improvement set forth in claim 15, wherein a machine bed is provided, said gripping means are carried by said machine bed, said first tool-positioning means comprise a carriage, which is carried by said machine bed and movable relative thereto along said longitudinal axis, said third tool-positioning means comprise a compound slide, which is carried by said carriage, and said tool is carried by said compound slide and movable by said compound slide relative to said carriage in two directions, which are normal to each other and to said longitudinal axis.

17. The improvement set forth in claim 12, wherein a machine bed is provided, said first tool-positioning means comprise a carriage, which is carried by said machine bed and movable relative thereto along said longitudinal axis, said feed drive comprises a carrying ring, which is rotatably mounted on said longitudinal carriage, said second tool-positioning means comprise a radially movable slide, which is mounted in said carrying ring and radially movable relative to said carrying ring, and a machining unit comprising said tool drive and said tool is carried by said radially movable slide.

18. The improvement set forth in claim 17, wherein said gripping means are carried by said machine bed, said third tool-positioning means comprise a compound slide, which is carried by said carriage, and said carrying ring is rotatably mounted in said compound slide and movable by said compound slide relative to said carriage in two directions, which are normal to each other and to said longitudinal axis.

* * * * *